United States Patent [19]

Trimble

[11] Patent Number: 4,997,602

[45] Date of Patent: Mar. 5, 1991

[54] CAST-IN-PLACE MANHOLE LINER METHOD

[75] Inventor: Carroll O. Trimble, Springdale, Ark.

[73] Assignee: Action Products Marketing Corporation, Johnston, Iowa

[21] Appl. No.: 415,862

[22] Filed: Oct. 2, 1989

Related U.S. Application Data

[62] Division of Ser. No. 240,073, Sep. 2, 1988, abandoned.

[51] Int. Cl.[5] ..... B28B 1/16; B28B 7/28; E02D 29/12; E02D 37/00

[52] U.S. Cl. ..... 264/32; 249/10; 249/184; 264/33; 264/34; 264/35; 264/36; 264/219; 264/254; 264/256; 264/269; 425/63

[58] Field of Search ..... 264/30, 31–35, 264/36, 219, 254, 256, 262, 269; 425/11, 59, 63; 249/179

[56] References Cited

U.S. PATENT DOCUMENTS

| | | | |
|---|---|---|---|
| 992,782 | 5/1911 | Lambie | 264/32 |
| 3,542,327 | 11/1970 | Herzog | 264/294 |
| 3,729,165 | 4/1973 | Trimble | 249/144 |
| 3,745,738 | 7/1973 | Singer | 264/34 X |
| 3,815,214 | 6/1974 | Kyle, Sr. | 264/274 X |
| 3,847,339 | 11/1974 | Farrell | 249/179 |
| 4,081,167 | 3/1978 | Heinzle | 249/184 X |
| 4,085,918 | 4/1978 | Wilkerson | 249/179 X |
| 4,119,291 | 10/1978 | Polito | 149/184 |
| 4,127,990 | 12/1978 | Morrow | 264/32 X |
| 4,205,949 | 6/1980 | Hanson | 264/33 X |
| 4,261,541 | 4/1981 | Morrow | 264/32 X |
| 4,484,724 | 11/1984 | Srackangast | 249/11 |
| 4,799,824 | 1/1989 | Kumai et al. | 264/34 X |

FOREIGN PATENT DOCUMENTS 1197007 7/1968 Fed. Rep. of Germany .

OTHER PUBLICATIONS

Action Products Co., Action Products Sales Flyer, 1985, pp. 1–4.

*Primary Examiner*—Jan H. Silbaugh
*Assistant Examiner*—Karen D. Kutach
*Attorney, Agent, or Firm*—Zarley, McKee, Thomte, Voorhees & Sease

[57] ABSTRACT

A collection of sheet-metal, flanged, arcuate panels is provided which panels can be assembled in belts of generally circular cross-section commencing from the bottom of the manhole to provide a complete form structure for casting a concrete liner with a minimum thickness of about three inches and including openings created by sectional cylindrical inserts, all of which can be assembled, then disassembled after the concrete liner has set. An extensive variety of panels to accomodate different shapes of manholes includes panels for forming right conical belts, for forming offset conical belts, and for forming wedge-shaped belts to make transitions between vertical and tilted sections of the manhole. A key-panel for these various belts is provided to prevent capture of the panels by the poured concrete liners which includes a relatively narrow portion with vertical flanges fixed at an angle to one another which angle diverges toward the center of the form structure. The methods include jacking the form structure after a part of the liner has been formed and poured to cause it to fit relative to the manhole and inlet pipes into the manhole, before pouring the remainder of the liner.

6 Claims, 10 Drawing Sheets

CAST-IN-PLACE MANHOLE LINER METHOD

This application is a division of application Ser. No. 07/240,073 now abandoned, filed Sept. 2, 1988, entitled CAST-IN-PLACE MANHOLE LINER APPARATUS AND METHOD, now pending.

The present invention relates to a method for casting concrete liners in existing, deteriorated manholes so that they will have many years of useful, substantially maintenance-free life. Pre-cast concrete manhole walls have been known for many years including some such manhole construction methods for casting poured concrete walls for new manholes in place, as shown and described, for example, in U.S. Pat. No. 3,729,165 granted Apr. 24, 1973 to Carroll O. Trimble (Cl. 249/144).

Forms for poured concrete manholes typically include steel shell outer and inner forms designed to be disassembled and reused. Inner forms for new poured concrete manholes have been used by themselves to cast concrete liners for the renewal of old, existing manholes, but the methods used for producing new cast-in-place manholes in many instances are not adaptable for casting liners in existing, deteriorating manholes.

While there is an overall similarity in manhole configurations attributable to the common purpose of giving access to sewer lines, the variety found in manhole configurations over the last fifty to one hundred years is great, and previously known poured concrete construction methods are inadaptable to a substantial percentage of manholes which are in need of renewal. The method according to the present invention, on the other hand, provides an adaptable process by which manholes requiring renewal with non-standard, odd configurations may be provided with complete and effective poured concrete liners. Since the alternative to renewing manholes with a poured concrete liner is removal of the manhole and replacement with a new manhole of poured concrete or other construction, and since this may frequently involve removal and replacement of poured concrete road surfaces or other structures, the economy of effort and savings produced by the present invention are very substantial.

Previous methods and apparatus for pouring concrete manholes or liners therefor are exemplified by several prior patents. A very early form of poured concrete manhole is shown in U.S. Pat. No. 992,782 granted May 23, 1911 to C. S. Lambie. The Lambie apparatus comprises internal forms consisting of downwardly flaring sections of annular shells "with the diameter of each corresponding to those above and below the same". The resulting poured concrete manhole then has a continuously flaring wall from the top to the bottom (although some portions may have a greater angle of flare than others).

Lambie makes no provision for removing the internal forms other than allowing the bottom section of forms to drop down after being disconnected and each upwardly adjacent section to be removed successively in a similar manner. Thus the Lambie arrangement would be quite inappropriate to meet the requirement to which the present invention is directed, namely the lining of existing manholes which may have a downward flaring, a nonflaring, or even an upward flaring configuration in parts. U.S. Pat. No. 4,127,990, granted Dec. 5, 1978, to Otis L. Morrow (CL. 405/36), shows a method for casting poured concrete manholes, but does not specify details of the apparatus which, presumably, would come from other prior art. The method is adaptable to new construction rather than renewal of existing manholes.

While the above-mentioned patent to Trimble U.S. Pat. No. 3,729,165 shows forms for poured concrete manholes which may be adapted to casting liners in existing manholes in a rudimentary manner in a limited number of cases, the forms shown in the U.S. Pat. No. 3,729,165 are inadequate for casting liners in many forms of manholes encountered.

The method and apparatus according to the present invention includes features for dealing with the problem of lining manholes of unusual configuration including wedge sections for dealing with slanted manhole portions, eccentric or skewed reducers for manhole offsets, methods and apparatus for bottom configurations without conventional benches for supporting the form structure and combinations of such problems. Also the apparatus according to the invention includes improved key-panel construction which is generally included in each filler belt or reducer greatly facilitating rapid removal of the forms either from the top down or the bottom up. A very important feature is that the lining process can be carried out completely without interfering with normal flow through the manhole. Normal flow is ensured in part by provision of inserts or other forms for producing an opening in the manhole liner communicating with the inlet or outlet openings in the manhole.

Prior provisions for producing an opening in the wall of a poured concrete manhole as shown in U.S. Pat. No. 4,261,541 to Otis L. Morrow, granted Apr. 4, 1981 (Cl. 249/10), have not been intended to be adaptable, and would not be adaptable, to permitting unimpeded flow through the manhole while a liner was cast in place. The Morrow apparatus is intended for and is only suitable for new manhole construction where the sewer pipe would be installed after the manhole wall was cast with an opening to accomodate the sewer pipe.

In addition to providing the features and advantages discussed above it is an object of the present invention to provide a method and apparatus for casting poured concrete liners in existing manholes which will be impervious to the influx of surface water or ground water and restore structural integrity to the manhole without taking the manhole or the sewer lines involved out of service.

It is another object of the present invention to provide a method and apparatus for casting poured concrete liners in existing manholes which are adaptable to manhole configurations with various combinations of conical and cylindrical sections with vertical or non-vertical axes with a wide range of diameters.

It is yet another object of the present invention to provide a method and apparatus for casting poured concrete liners in existing manholes with multiple inlet lines at the bottom or above the bottom of the manhole.

It is a further object of the present invention to provide methods and apparatus for casting poured concrete liners in existing manholes which are able to accomodate manholes with non-vertical portions or eccentric conical portions needed to avoid surface structures.

It is a still further object of the present invention to provide a method and apparatus for casting poured concrete liners in existing manholes which accomodate manholes where the main sewer line is off-center in the manhole or partly outside the periphery of the manhole.

Other objects and advantages of the invention will be apparent from consideration of the following description in conjunction with the appended drawings in which.

Figure 1:
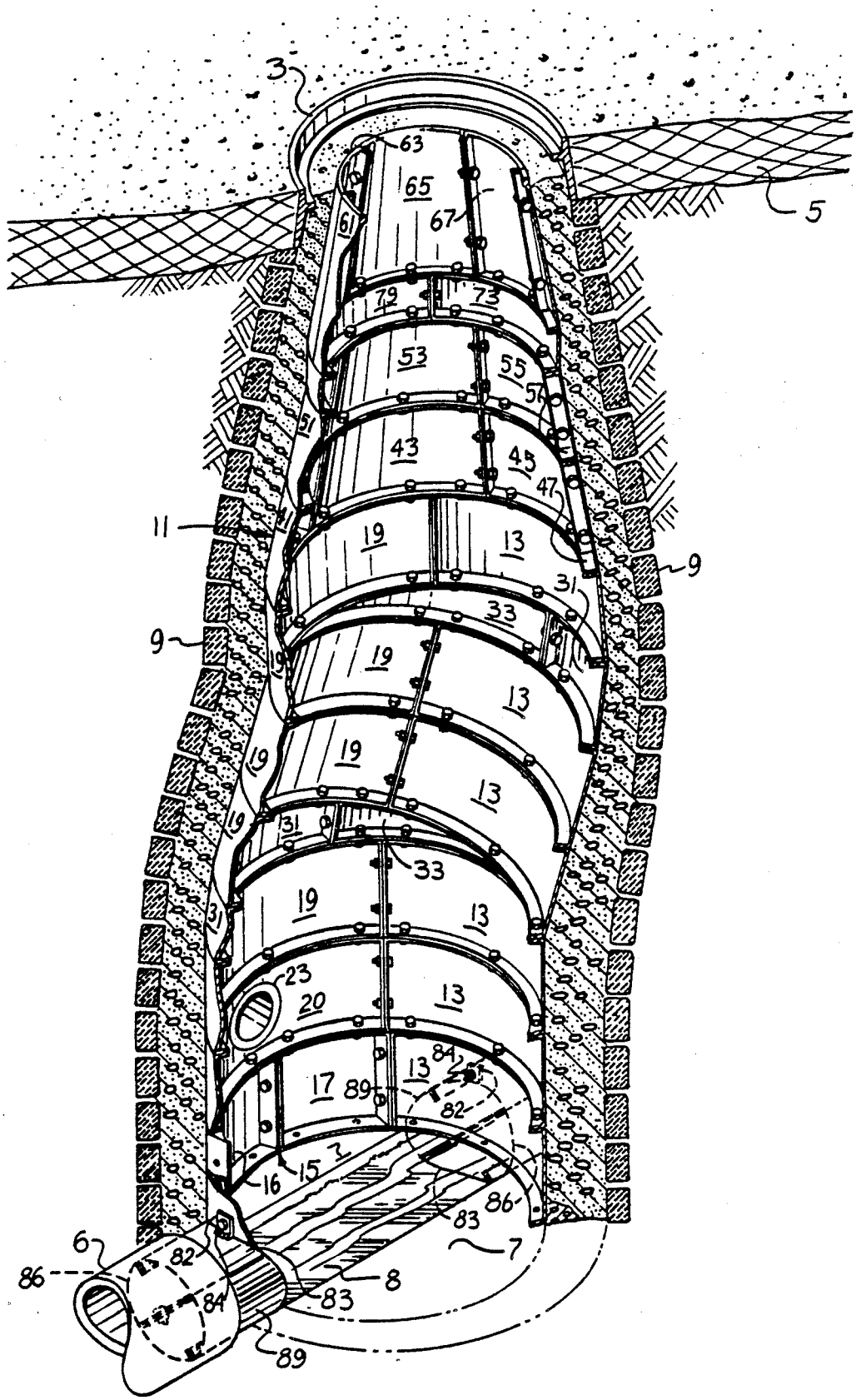
FIG. 1 is a perspective view (partially broken away) showing a form configuration according to the invention for casting a poured concrete liner in a non-standard manhole with non-vertical portions.
Figure 2:
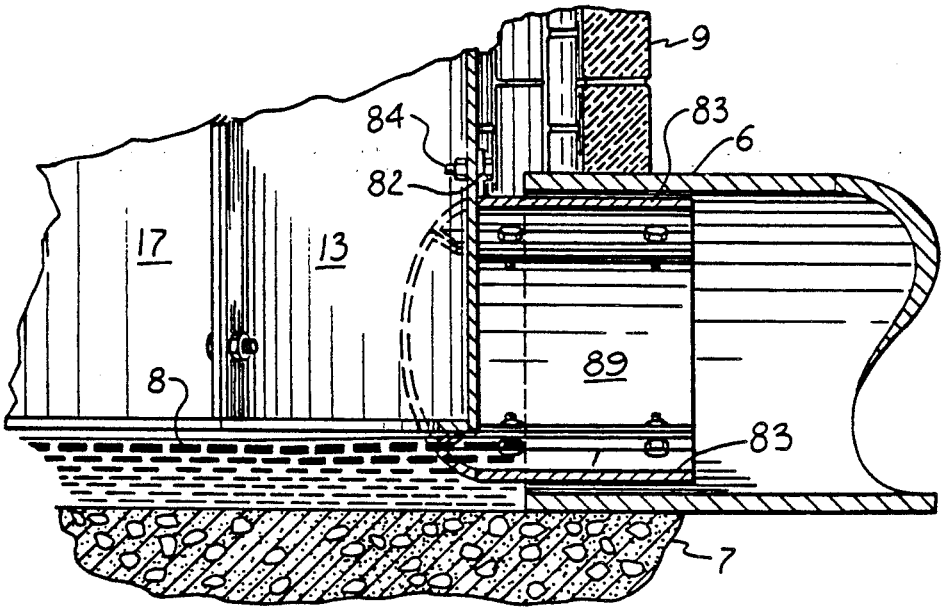
FIG. 2 is an enlarged fragmentary vertical sectional view showing an insert for forming an outlet hole in the bottom of a manhole liner.
Figure 3:
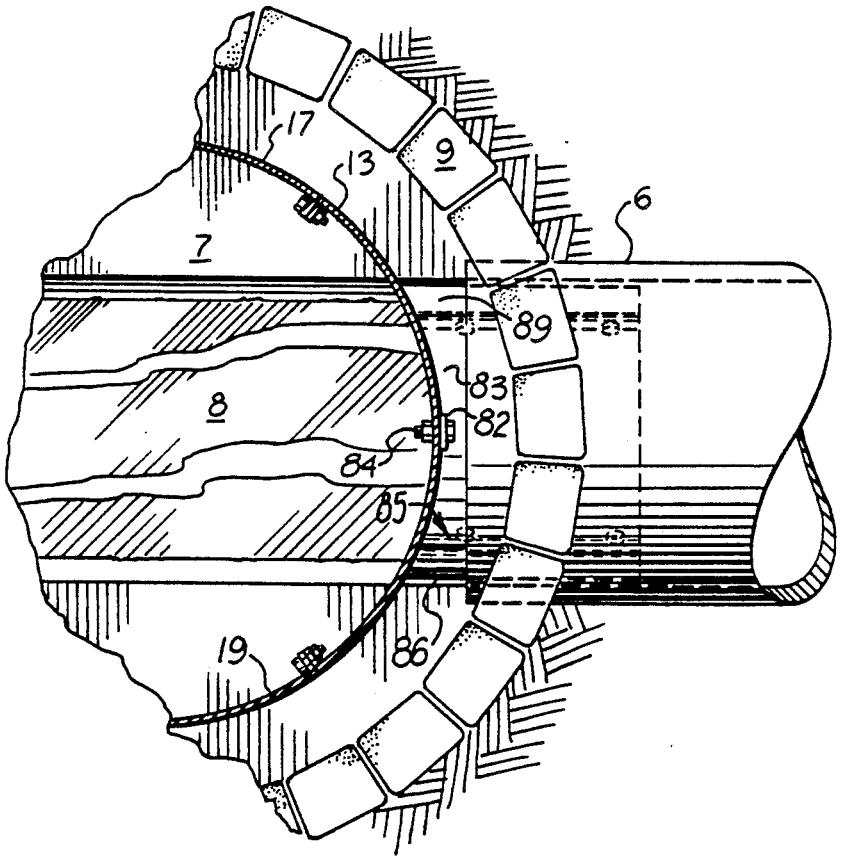
FIG. 3 is an horizontal sectional view of the apparatus of FIG. 2.

Referring now to the drawings and particularly FIGS. 1, 2, and 3, a form structure 11 is shown assembled in a manhole in a manner to conform to the configuration of the walls 9 of the manhole.

The floor 7 of the manhole is typically provided with a trough 8 to channel the sewage from one or more inlet pipes to an outlet pipe. Frequently a manhole will be situated under pavement 5 of a parking lot, road, or the like as shown in FIG. 1. A cover ring 3 is secured at the top of the manhole substantially flush with the pavement 5 and adapted to receive a manhole cover (not shown).

The form structure 11 is built up of various forms of arcuate sheet metal panels such as panel 13 in the form of a sector of a cylinder. Panels 13 are provided with peripheral flanges which serve to strengthen the panel and also as convenient means for fastening through-holes therein with bolts so that the panels may be connected to horizontally adjacent and vertically adjacent panels of similar or dissimilar form. Although panels such as 13 could be formed of rigid plastic or other material, sheet metal joined by welding is preferred.

A contractor or other entity involved in renewing manholes with poured concrete liners according to the present invention will be provided with a rather extensive set of panels for assembling a nearly unlimited variety of form configurations. The nature of the forms provided can best be understood by reference to the following TABLE 1 which identifies the basic types of panels.

It will be noted that the form is built up with a succession of tiers or belts (hereinafter referred to as belts). The most common filler belts are made up of filler panels and a complete belt takes the form of a right circular cylinder. Typically each belt will be made up of four or six panels of the same height and subtending substantially equal angles. These panels are not identical, however, and, in particular, one such panel is divided into two parts and is referred to as the key-panel. One of the two parts of the key-panel has side flanges which are arranged at a small angle with respect to one another, such angle diverging toward the center of the form structure. Thus when the bolts or other fasteners holding this half of the key-panel in place are removed, it will readily slide inward to create an opening in that belt of panels after which the panels are no longer locked in place by their inwardly converging side flanges and may readily be removed.

Figure 4:
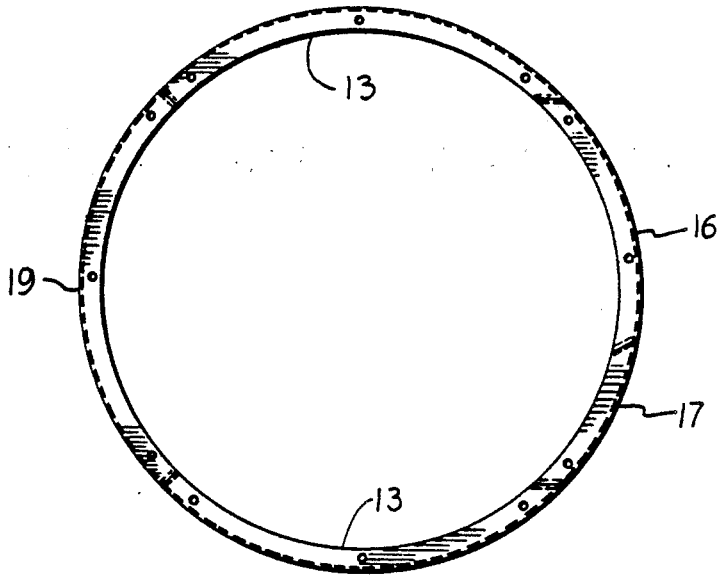
FIG. 4 is a top plan view of a group of filler panels including a key-panel to facilitate disassembly thereof.

In FIG. 1 the key-panel 15 of the bottom-most belt is formed of two portions 16 and 17. Panel portion 16 has inwardly diverging side flanges. This bottom-most belt has three other panels, one panel 13 being shown, and another panel (like panel 13) not shown, plus a fourth panel opposite key-panel 15 (not shown). As shown in FIG. 1 and FIG. 4, key-panel 15 has side flanges at its edges which are parallel to one another and the side flange of panel 13 which is adjacent to key-panel 15 is configured to fit key-panel 15. The same is true of the other panel which is adjacent to key-panel 15 on the other side.

All the other belts of panels in FIG. 1 are shown with a different rotation and the key-panel which is present in these belts is not shown. For example, the belt third from the bottom shows a panel 19 and a panel 13, panel 19 being the panel opposite the key-panel for that belt. It will be noted that key-panel 19 has flanges which are radial or at right angles to the cylindrical surface and the flange at the adjoining edge of panel 13 is also radial. To aid workers in proper assembly of the panels they may be identified by diameter and also by single digit numbers identifying which one of the panels of a belt set is represented. For example, the panels of a four panel belt could be identified with key-panel as No. 1 and adjacent panels in a clockwise direction as No. 2, No. 3, and No. 4. The key-panel portions could be identified as 1-A and 1-B if desired.

Although the requirement for proper placement of different types of panels in a belt requires some care, it has the advantage that it is hard to mistakenly assemble a belt of panels without a key-panel. Clearly, omission of a key-panel in a belt would make the panels impossible to remove without destroying them once the concrete had been poured and set.

It is an important feature of the present method and apparatus for lining manholes that the sewer lines are maintained in service. In the situation illustrated in FIG. 1, the installation of apparatus to accomplish this result is in part illustrated in FIGS. 2 and 3. As seen in FIGS. 2 and 3 trough 8 divides the floor 7 of the manhole into two parts (sometimes referred to as benches) and in many cases the form structure 11 may be set directly on the floor 7 of the manhole without impeding the flow through trough 8 and thus leaving the manhole and sewers operable during the lining process.

To provide an opening in the liner wall, a cylindrical insert formed of sections 83, 85, and 89 is placed inside pipe 6 and abutting panel 13. The sections 83, 85 and 89 are curved on one end to fit or substantially fit the arcuate surface of panel 13 which, in the case of FIG. 1, has a diameter of 42 inches. The sections 83, 85 and 89 could be curved on the other end to fit a cylinder with the same or a different diameter. The sections 83, 85 and 89 are configured in a manner similar to the previously described belt of panels 13, 15 and 19 at the bottom of the form structure 11 in FIG. 1. That is, at least one section 85 of the insert has two parts 86 and 87, the latter with inwardly converging flanges so that it can be readily taken out after the insert is used as a core in the poured concrete. This releases the other sections to be removed as well. Obviously, a permanent insert could be used as a core consisting of a single unitary cylinder which would not be removed.

Preferably one of the sections 83 has a bracket 82 secured thereto so that it and the other sections can be secured against panel 13 by a bolt 84 or other fastener. Bracket 82 may be provided with a slot rather than a circular hole to allow up and down adjustment of section 83 relative to panel 13. Also panel 13 may have more than one hole to accomodate a bolt 84 for further adjustability in positioning of section 83 and the other sections of the insert. It may be noted that small holes or apertures in the panels or between the panels a quarter of an inch or less do not permit passage of the concrete mixture and an assembled form structure need not be water tight. In disassembling a form structure after the concrete has been poured and set, the bolt or other fastener for 84 will be loosened to release panel 13 from the insert and after panel 13 has been removed, the sections 83, 86 and 89 of the insert will be disassembled to the extent necessary to remove them from the pipe 6 and from the concrete liner which has been poured around them.

In the case of sewer pipes which enter the manhole above the level of floor 7, a gate panel 20 is provided having a gate 23 with an opening and a removable circular coverplate conforming to the outside diameter of a six or eight inch sewer pipe; the end of the sewer pipe extends through the opening of gate 23 in the panel 20 and the sewer pipe thus remains in service while the liner is being poured and, of course, afterward. Other sizes of gate openings may be provided as needed. If necessary, space between the outside of the sewer pipe and the edge of the gate opening may be caulked or grouted to prevent flow of concrete mix to the interior of the form structure 11.

The position of gate 23 may be conformed vertically to the position of the sewer by jacking the form structure 11 as will later be explained in detail. The belt of panels including panel 20 may be rotated to properly position gate 23 with respect to the sewer pipe and, if the desired position does not cause bolt holes to match up in the horizontal flanges, the flanges may be secured together by clamps rather than the usual bolts 10.

In a panel such as panel 13 subtending about 90°, the horizontal flanges may have bolt holes placed up to about 45° apart giving two bolt holes in each horizontal flange of panel 13. Obviously a greater number of bolt holes may be provided as shown or a variety of other bolt hole configurations could be adopted if desired.

As it will be seen in FIG. 1, a number of belts formed of panels 13 and 19 (and also key-panels 15 not shown) provide groups of filler panels of 42 inch diameter extending upwardly in the manhole. Also shown are wedge panels 31 and 33 which serve to provide a tilt in the form structure 11 to conform to the configuration of the manhole walls 9.

Figure 7:
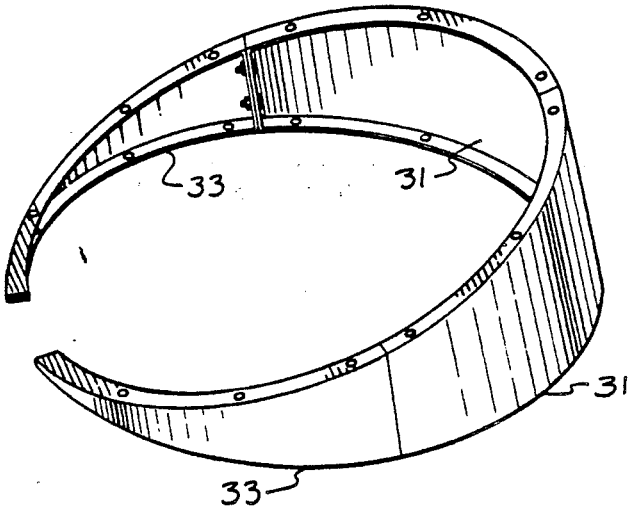
FIG. 7 is a perspective view of a wedge filler form.

A detail of wedge panels 31 and 33 is best shown in FIG. 7 where it will be seen that two each of panels 31 and 33 are connected together to form a generally wedge-shaped belt. Preferably panels 33 are shaped to serve as right side or left side panels by inverting them, and the same is true of panels 31. Panels 33 are preferably somewhat less than 90° in angular measure leaving about two to four inches gap in the circumference of the belt. This portion of the panels would be very thin and is not necessary to provide an adequately tight structure to hold the concrete mix. Due to the gap in the circumference of the wedge-shaped belt formed by panels 31 and 33 there is no need for a key-panel since either of the panels 33 can be removed to release panels 31. Wedge panels of two inch height may be only three in number with a gap of about 90°.

It will be noted that there are two wedge-shaped belts of panels 31 and 33 in FIG. 1. The lower one of the wedge-shaped belts causes a tilt for two filler belts and the upper wedge-shaped belt causes the axis of the form structure to be restored to vertical for those belts above.

As the diameter of the manhole walls 9 reduces near the top of the manhole, reducer panels 41, 43, 45 and 47 (and two other panels not shown) form a reducer belt to reduce the form structure diameter from 42 inches to 36 inches.

A further belt formed of panels 51, 53, 55 and 57 and two other panels reduces the diameter of the form structure from 36 inches to 30 inches. The next belt is a filler belt of 30 inch diameter but only eight inches high and is formed of panels 79 and 73 and two other panels. At the top of the form structure is a group of panels 61, 63, 65 and 67 and two other panels not shown reducing the diameter of the form structure from 30 inches to 26 inches.

Figure 5:
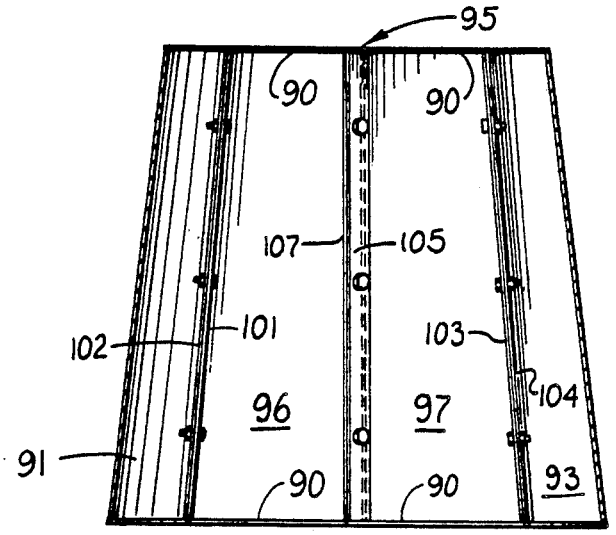
FIG. 5 is a vertical sectional view of a reducer form including a key-panel and other panels.
Figure 6:
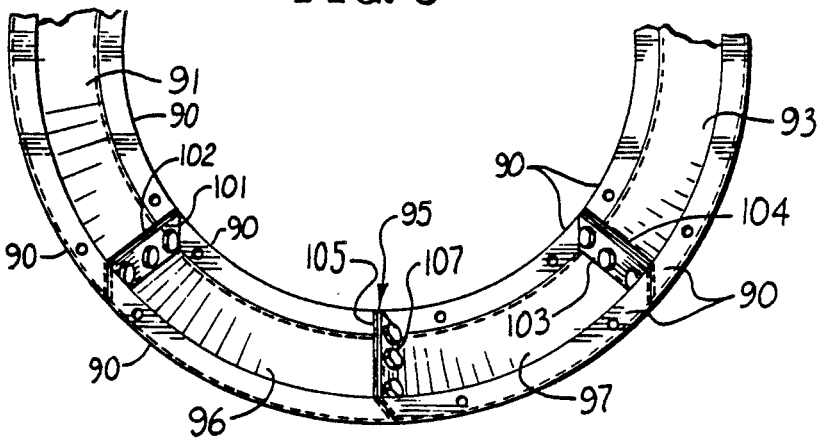
FIG. 6 is a fragmentary bottom plan view of the apparatus of FIG. 5.

In some instances, a still smaller reducer for reducing the diameter from 26 inches to 20 inches will be useful. Such a reducer is illustrated in FIGS. 5 and 6. As noted in TABLE 1, the small reducer has only four panels (91, 95, 93 and one not shown in FIG. 5) per belt rather than six panels as is the case with the larger reducers, otherwise it is typical.

Panel 95 is the key-panel formed of two panel portions 96 and 97 and adjacent to it on either side are panels 91 and 93 which differ only in being left-handed and right-handed mirror images. A fourth panel not shown subtends about 90° of the conical form and has radial side flanges similar to the cylindrical panel 19 of FIG. 4.

As best seen in FIG. 5, side flanges 101 and 103 of panel 95 have junctions with top flanges 90 which are parallel lines. The junctions of side flanges 101 and 103 with bottom flanges 90 are also parallel lines. Since flanges 101 and 103, if set perpendicular to the surface of the cone, would have an angle in the horizontal of about 90°, this means that each flange 101 and 103 is set at an angle of about 45° with the surface of the cone. Flange 102 of panel 91 and flange 104 of panel 93 are also set at an angle of about 45° with the surface of the cone so that they fit flush with flanges 101 and 103, respectively. This angular orientation for flanges 101, 102, 103 and 104 is somewhat arbitrary and is subject to variation.

The two portions 96 and 97 are provided with flanges 107 and 105, respectively, so that the two portions 96 and 97 may be assembled and disassembled as are the panels of a group of panels. It will be seen that the junction of flange 105 of panel 97 with top flange 90 or bottom flange 90 is not parallel to the corresponding junction of flange 103 with top flange 90 or bottom flange 90. Rather flange 105 is tilted at an angle with respect to flange 103 such that the angle is diverging toward the center of the reducer.

Flange 107 of panel 96 has a corresponding tilt to mate with flange 105. Thus when the bolts or other connectors connecting flange 105 to flange 107 and flange 103 to flange 104 are removed, as well as any bolts through flanges 90, panel portion 97 is readily moved inward to break the circle of panels. Thereafter panel portion 96 may readily be removed and all the other panels of the group or belt disassembled.

The angle of flanges 105 and 107 relative to the surface of the cone is shown as about 45° and while this is a satisfactory angle it is not necessary that the tilt angle be that great and it may be in some cases as low as 5°. It will be understood that the fluid pressure of the liquid concrete mix tends to set up a compressive force clamping together the vertical (or near vertical) edges of the panels and the tilt of flanges 105 and 107 permits the release of the clamping force by inward movement of panel 97. After the concrete is poured and set only inward movement is possible.

Figure 8:
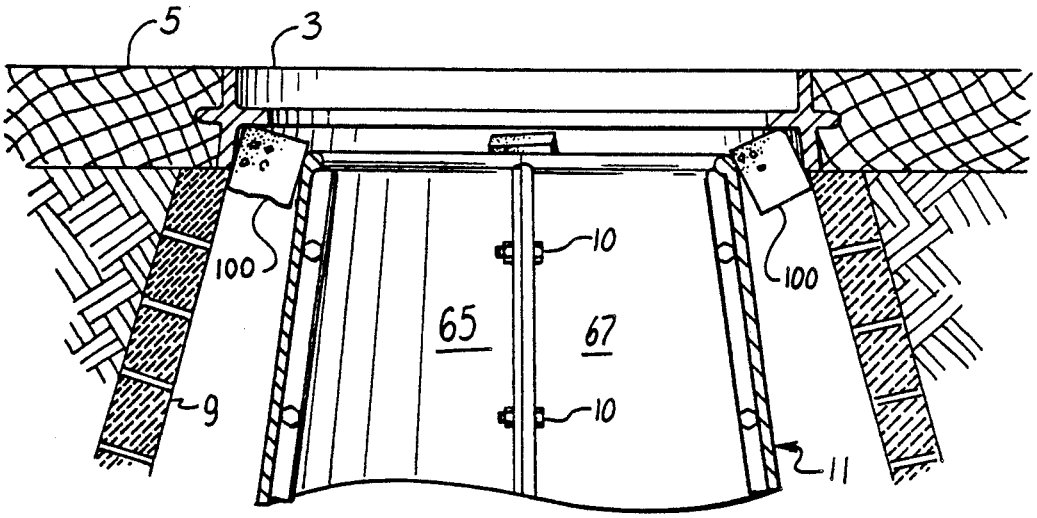
FIG. 8 is a fragmentary enlarged sectional view showing the relation of a form as in FIG. 1 to an existing manhole cover.

FIG. 8 is a sectional view of the top portion of the form structure 11 showing how it is positioned in the top of the manhole. FIG. 8 shows the arrangement before the concrete is poured to form the liner. Any conveniently available wood blocks 100 (or bricks) may be utilized to temporarily hold the form structure 11 in place when pouring is commenced so that the axis of the liner will be centered relative to the manhole cover rim 3. Blocks 100 will normally be removed after about two-thirds of the liner is poured to facilitate finishing the liner to near the top of panels 65 and 67 and the top of the form structure 11.

Figure 9:
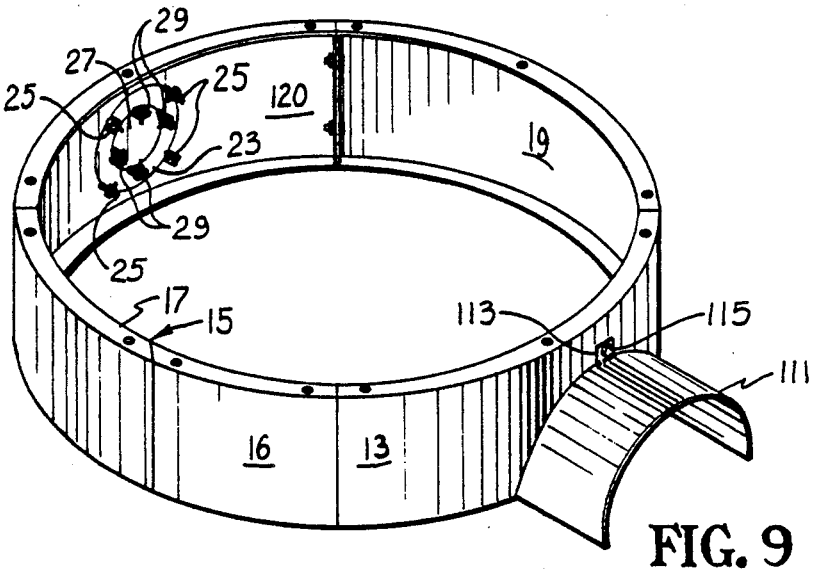
FIG. 9 is a perspective view of a group of filler panels and a canopy form as alternative means for creating bottom openings in a manhole liner.

FIG. 9 shows alternative means for forming a hole in the poured concrete liner at the location of an inlet or outlet sewer pipe. Flexible sheet metal canopy 111 is three to four inches in width and bridges the distance between panel 13, for example, and the wall of the manhole. Its inside edge is curved to conform to the contour of panel 63 as was the case of the sectional insert shown in FIGS. 2 and 3 and the outer edge of canopy 111 is preferably curved to conform to the manhole wall curvature. Canopy 111 is provided with a bracket 113 and is secured to panel 13 with a bolt 115 or other fastener.

Also in FIG. 9, panel 120 is provided with a gate 23 including a removable circular cover plate which may be about nine inches in diameter. Cover plate and panel 120 are provided with sheet metal tabs 25 by means of which the gate 23 is bolted or otherwise in panel 120 when no opening is desired. A smaller circular cut-out 27 may also be provided in gate 23 with additional tabs 29 for removably securing it in place. Thus the entire gate 23 is removed when a large opening (e.g. for eight inch pipe) is desired and only the central cut-out 27 is removed when a smaller opening (e.g. for six inch pipe) is desired. The arrangement of FIG. 9 would provide for an inlet sewer pipe which was only slightly displaced above the floor of the manhole and an outlet sewer pipe which was partially below the floor of the manhole.

Figure 10:
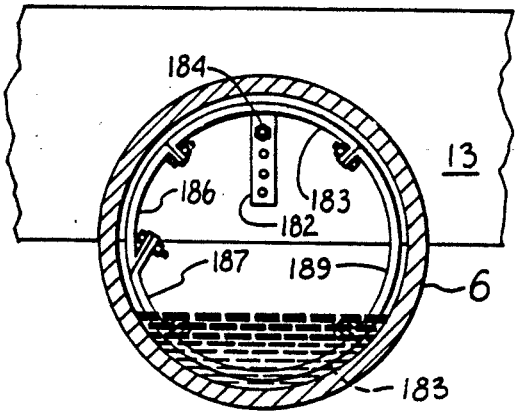
FIG. 10 is a sectional view of an alternative form of insert comparable to that shown in FIGS. 2 and 3.
Figure 11:
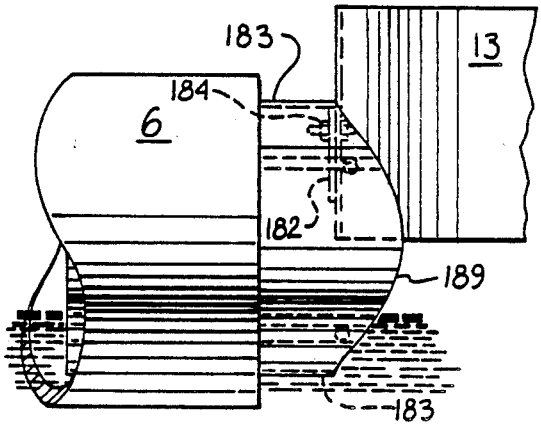
FIG. 11 is a side elevational view of the apparatus of FIG. 10.

Another form of insert to maintain a sewer pipe opening in the liner is shown in FIGS. 10 and 11. Sewer pipe 6 has inserted therein an insert comprising sections 183, 189, 183, 186 and 187 which are disassembled after the concrete is poured by first removing section 187 to break the circle and thereafter removing the other sections of the insert. The apparatus of FIG. 10 differs from that shown in FIGS. 1, 2 and 3 in that the bracket 182 is inside the insert and is provided with a number of holes for adjustable positioning of the insert relative to panel 13. It will be noted that an opening should always remain between the bottom of panel 13 and the bottom of insert section 183 to allow continued liquid flow in the course of the forming and pouring operation.

Figure 12:
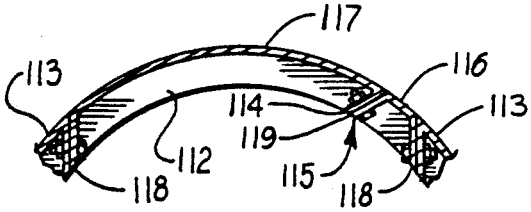
FIG. 12 is a sectional view of an alternative form of key-panel comparable to that shown in FIGS. 4, 5, or 6.

FIG. 12 shows an alternative form of key-panel in which the two portions of key-panel 115 are quite unequal in width with portion 116 only about a quarter of the width of portion 117. Portion 116 is the removable portion having diverging side flanges 118 and 119. It may be noted that due to the small width of panel 116 flange 119 is almost at a right angle to the surface of panel 115, yet there is ample divergence of flanges 119 and 118 toward the center of the cylinder.

Outer edge flanges 118 of panel 115 are illustrated as being parallel as in key-panel previously described. Thus the key-panel 117 illustrated in FIG. 12 is compatible with the previously described structure. It should be further noted, however, that there is no requirement that a system of forms according to the invention should have key-panels with parallel vertical edge flanges 118 as illustrated. In fact, flanges 118 and the adjacent flanges on panels 113 could be radial when the unbalanced key-panel 115 is utilized. Thus, an arrangement wherein all panels including the key-panel had radial edge flanges (i.e. flanges at 90° to the surface of the cylinder cone or other surface of revolution represented by the assembled panels) is within the scope of the invention.

Figure 13:
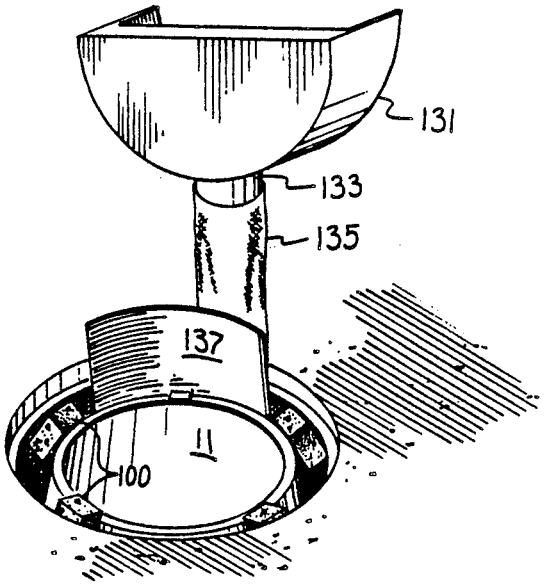
FIG. 13 is a perspective view showing a method and apparatus for pouring concrete into the cavity between the form structure according to the present invention and the pre-existing manhole wall.

FIG. 13 illustrates accessory apparatus useful in pouring the concrete to form the liner with the method of the present invention including a funnel 131 to be attached to the end of a concrete mix delivery vehicle chute. Funnel 131 feeds into a tube 133 of sheet metal or the like which in turn feeds a flexible fabric hose 135 serving to deliver the flow of concrete mix to the space between form structure 11 and the manhole walls. A sheet metal shield 137 helps to keep concrete mix from spilling inside the form structure 11.

The process according to the invention starting from the beginning may be summarized as follows. The particular job having been examined and a source of concrete arranged, a suitably complete set of panels is brought to the site and assembly of the form structure commences on the floor of the manhole by one workman. The manhole is considered a hazardous environment and the appropriate precautions dictated by professional standards and government regulations are followed. These will not be discussed at length, but include continual observation of the worker in the manhole, immediately available means to lift him from the manhole if necessary, provision of a high volume of fresh air to the bottom of the manhole and limitation of exposure to fumes to the maximum extent possible. Since the erection of the form structure proceeds very rapidly this enhances the safety of the operation. Also the fact that no workman need be present in the manhole when the concrete is actually poured represents an additional safety factor.

A belt of panels is assembled on the floor of the manhole which will allow a minimum three inch clearance between the liner form and the old manhole wall. At this point it is generally necessary to fill large openings between the bottom of the panels and the floor of the manhole with a grout consisting of a mortar or concrete mix or other suitable mixture. At the same time it is necessary to install the inserts which will create the channels in the liner for inlet and outlet sewer pipes. Openings around the inserts will also be filled with grout so that the space between the bottom belt of panels and the old manhole wall is substantially closed at the bottom. Additional belts of panels are assembled on top of the bottom belt with reducers or filler panels arranged to maintain about a minimum three inch clearance between the liner form and the old manhole wall. Thicknesses of the liner greater than three inches are not detrimental but they increase the amount of concrete required without any compensating advantage.

When the form structure has been completed to extend to or above the top of the manhole, the top panel belt is centered with blocks as illustrated in FIG. 8 and the concrete mix may be poured from the delivery truck which is previously arranged for.

Preferably the concrete mix is three-quarter rock and is a conventional wall and foundation concrete mix except that it has greater amount of water to provide a wet mix that is easy to vibrate.

Two or three times in the course of the pouring operation the concrete is vibrated by rapping on the inside of the form with a light hammer or other tool. Mechanical vibrators that are inserted in a concrete mix are not necessary and are not customarily used.

After the concrete has set for one to three hours it is sufficiently firm to remove the form structure, and it is desirable to proceed on such a schedule.

Removal of the panels can proceed from the top or the bottom with successive belts of panels being dismantled by removing first the removable portion of the key-panel. Thereafter the other portion of the key-panel and the other panels are removed for that belt. The same procedure is used with successive belts until the form structure is entirely removed. It is necessary to disconnect those panels secured to inserts at the bottom of the manhole before removing them, and it is then necessary to break down the sections of the insert in a similar manner to remove them from the inside of the sewer pipes.

The form panels removed from inside the newly lined manhole may be returned to the collection of form panels which may then be delivered to the next job site. The process described above is then repeated for the next manhole liner installation.

Figure 14:
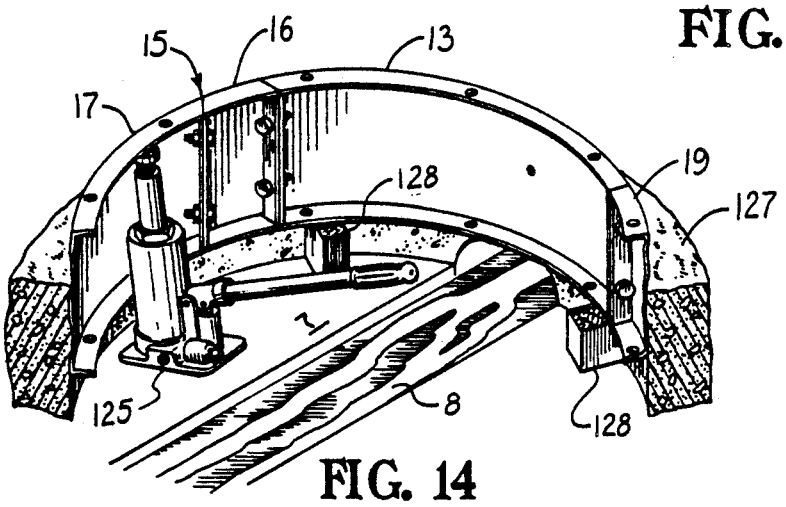
FIG. 14 is a perspective view (partially broken away) illustrating a method and apparatus for raising filler forms after part of the concrete liner has been poured.

FIG. 14 illustrates the method of adjusting the height of the form structure 11 for the purpose of aligning key-panels 20 with drop pipe inlets in the manhole, for adjusting the top of the form structure 11 to be flush with a wide manhole ceiling (as will be described with reference to FIG. 16), or for some other purpose.

The liner installation process begins as described above, except that only the lower one or two belts of panels are assembled in the beginning and only a small quantity of concrete mix is used to form the bottom of the liner. Inserts are set and grout is used to fill gaps all as described above.

When the concrete 127 has acquired sufficient consistency to retain its shape, the bottom panels, such as 13, 15, 19 and other panels not shown, are raised by a conventional hydraulic jack 125 or the like together with at least one other such jack (not shown) to achieve the desired vertical position of the form structure 11 when necessary (in many cases this step is not necessary). Blocks 128 are put in place to stabilize the form structure as required.

Panels are secured in place to construct the remaining portion of the form structure 11 as illustrated in FIG. 1 or in any of the following figures. Alternatively, the form structure may be assembled in part while the concrete 127 forming the base of the liner is setting. After the form structure is complete in its desired vertical position, the pouring of the concrete liner proceeds as described above, and the liner rests on the base formed by concrete 127. In FIG. 14 the inserts forming openings in the concrete 127 have been removed prior to the final pouring operation, but that step may be deferred until the entire form structure 11 is disassembled. Specific examples of application of this method will be seen hereinafter in FIGS. 16 and 17.

In some cases the sewage passage from inlet to outlet may be partly outside the periphery of the manhole requiring a large opening in a side wall for access. To preserve such an opening in the liner it may be desirable to omit one or more panels in the bottom belt of panels and seal off the vertical gap where the panel is omitted with a plywood or sheet metal rectangle. Similarly the horizontal gap in the superjacent belt will be closed with an arcuate sheet of metal or plywood as a floor.

The overhanging panel or panels and the floor provided are supported with jacks from below or cables from above while two or three panel heights of liner are poured and allowed to set. Thereafter the support is necessary and the form structure may be completed and the liner poured to complete the installation.

Figure 15:
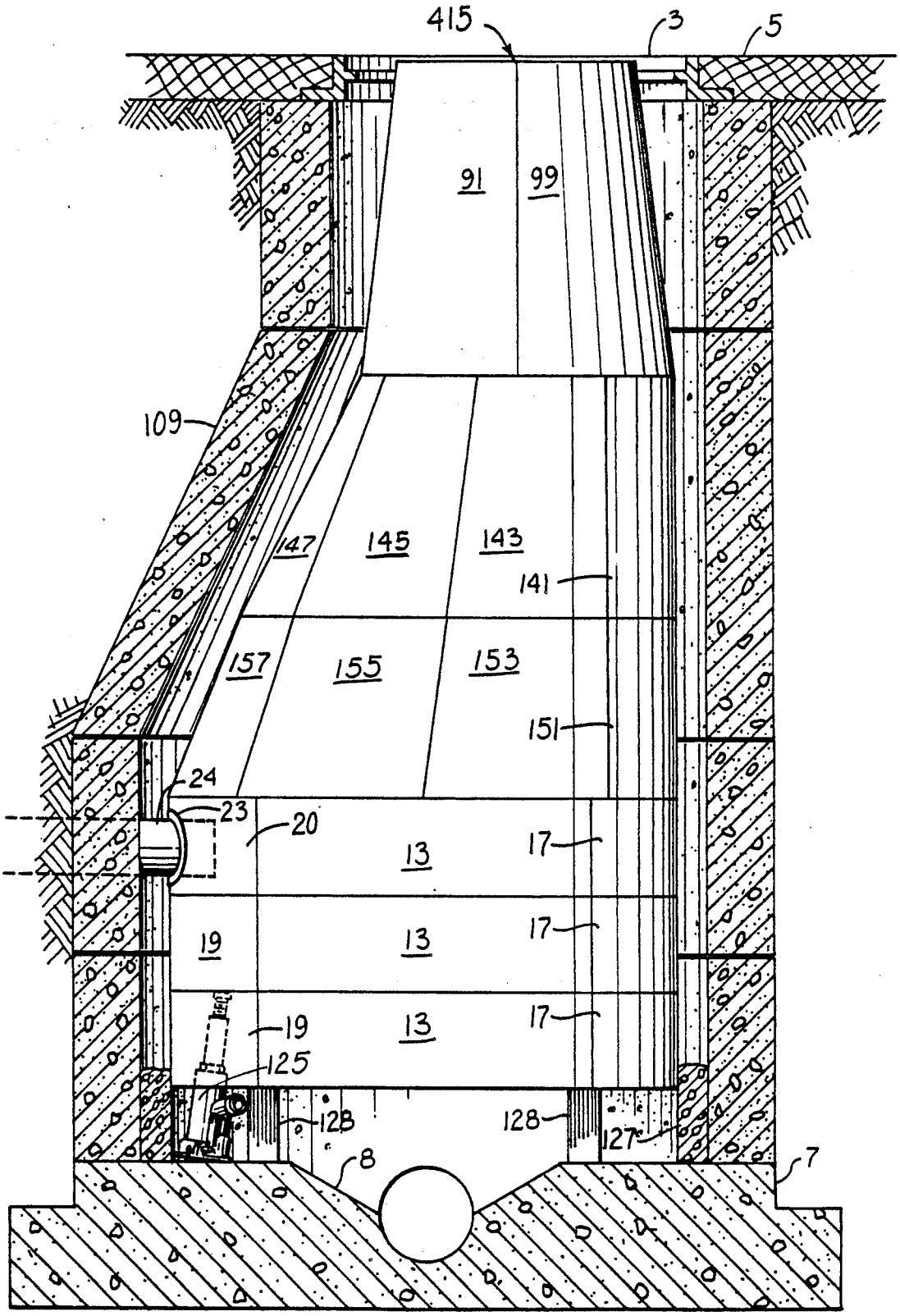
FIG. 15 is a side elevational view of a form structure according to the invention for an eccentric or offset manhole configuration.

FIG. 15 shows a form structure 415 for creating a liner in a manhole with walls 109 which are offset so that the top of the manhole is eccentric with respect to the bottom of the manhole. After pouring a liner base of concrete 127, form structure 415 has been raised by a jack 125 and blocked with blocks 128 as previously described with reference to FIG. 14.

The bottom three belts of form structure 415 are shown for illustration as 42 inches in diameter and formed by panels 13, 19, 20 and other panels not shown. A sewer pipe inlet 24 is elevated above the floor 7 of the manhole and is accomodated by gate panel 20 having gate opening 23 due to the adjustment of the form structure vertical position.

An offset reducer with diameters of 42 inches and 36 inches is formed by panels 157, 155, 153, 151 and other panels not shown, and a further offset reducer with diameters of 36 inches and 26 inches is formed by panels 147, 145, 143, 141 and other panels not shown. Topping out the form structure 415 is a common reducer with diameters of 26 inches and 20 inches formed of panels 91 and 99 and other panels not shown. The cavity between form structure 415 and manhole walls 109 is ready to be filled with concrete mix after which the panels of the structure would be disassembled in accordance with the method previously described.

Figure 16:
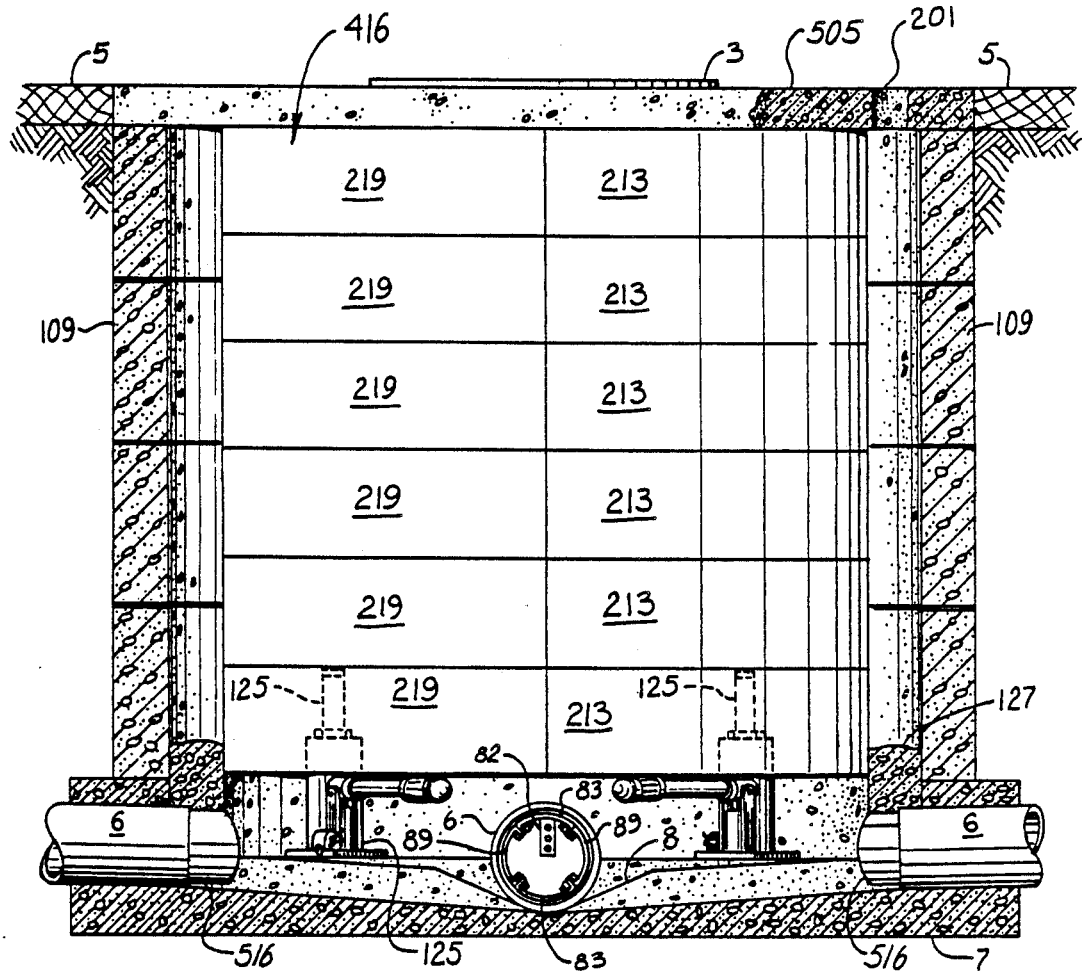
FIG. 16 is a side elevational view illustrating the apparatus and process for lining a non-tapered manhole configuration.

FIG. 16 shows a wide, flat top manhole with walls 109, a reinforced concrete top 505, and a manhole ring casting 3. The form structure 416 for lining this manhole includes panels 219, 213 and other panels not shown, yielding a liner for structure 416 of 48 inch diameter, for example. As previously described, jacks 125 have been employed to raise the form structure 416 to the desired vertical position after a liner base of concrete 127 has been poured as described with reference to previous embodiments.

At least one opening 201 is cut in the top 505 of the manhole to permit concrete mix to be poured between the form structure 416 and the walls 109 filling the cavity therebetween completely to the top leaving no gap between the top of the liner and the top 505 of the manhole. This is possible because the form structure 416 has been jacked up to be flush with the top 505 of the manhole. Any gaps which are large enough to be a problem may be caulked to adequately seal this junction. Pipe inserts 516 similar to the type previously illustrated or in other forms are used to produce an opening through the liner from sewer pipe 6 to the interior of the manhole. Except for creating the opening 201 in the top 505 of the manhole and filling it on completion of the liner, the method of operation for FIG. 16 is essentially as previously described.

Figure 17:
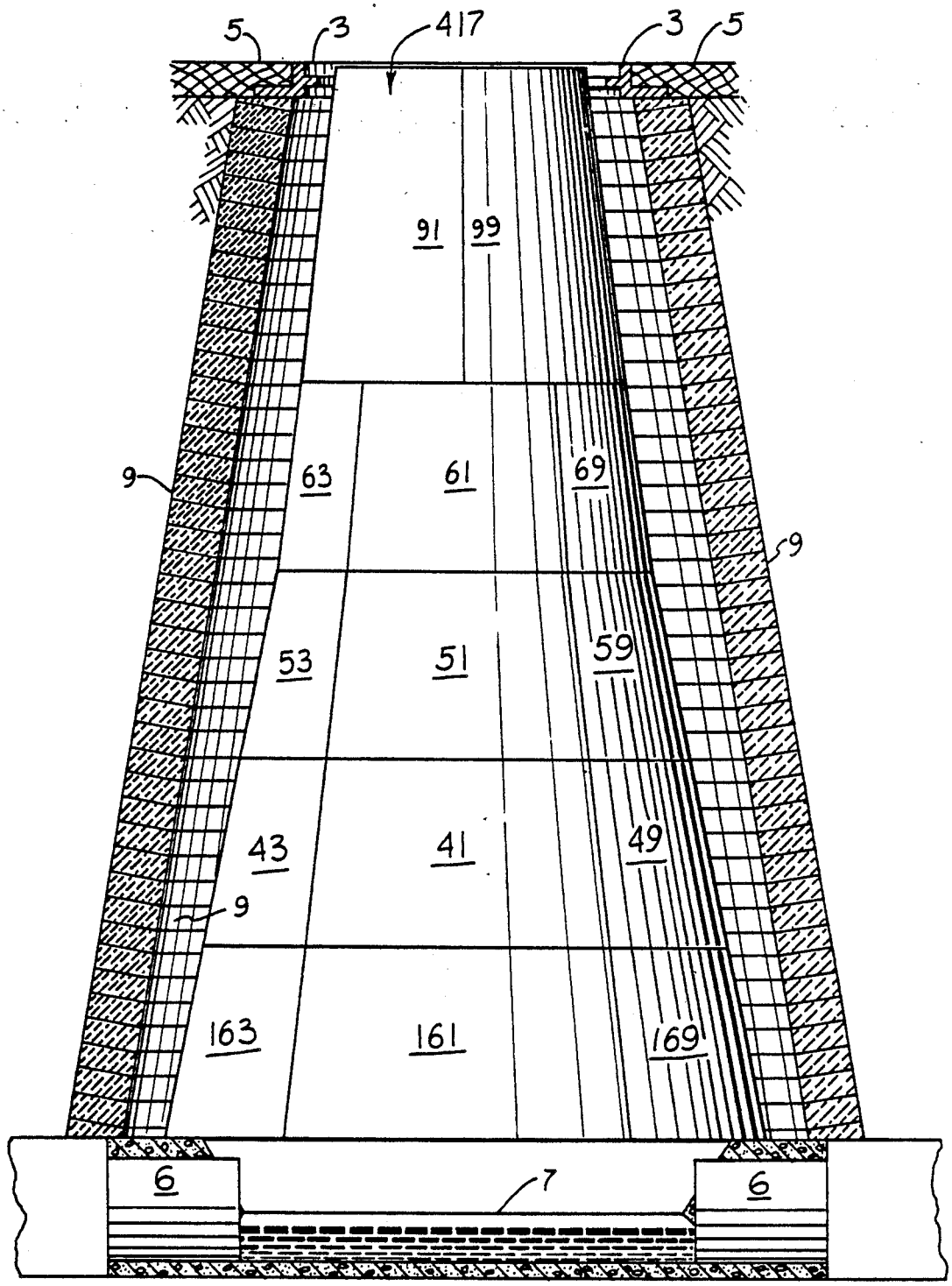
FIG. 17 is a side elevational view of a form structure for an all-tapered manhole configuration.

FIG. 17 shows a form structure 417 for a manhole with conical walls 9. A manhole of this type and certain of the other manholes may be in part above ground, but this does not materially affect the process of installing a liner. The form structure 417 of FIG. 17 tapers from 48 inches at the bottom to 20 inches at the top and from the bottom up is formed of panels 161, 163, 169, 41, 43, 49, 51, 53, 59, 61, 63, 69, 91, 99 and other panels not shown. The basic method of producing a liner would be used in conjunction with form structure 417 as previously described.

Figure 18:
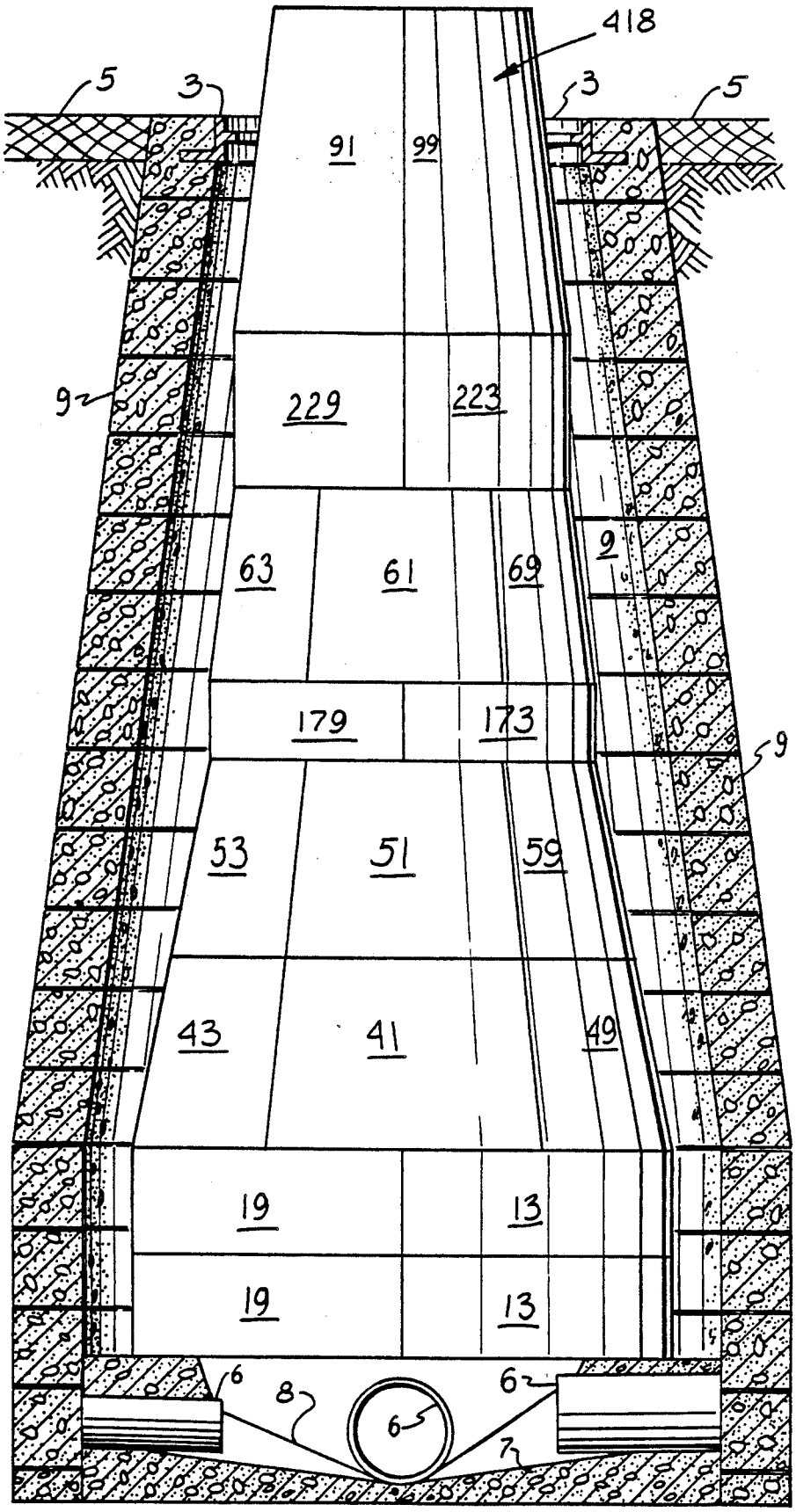
FIG. 18 is a side elevational view of a form structure for a partially tapered manhole configuration.

The basic method of casting a liner would also be used in respect to the manhole illustrated in FIG. 18 absent any elevated inlet sewer pipes or other complications. The form structure 418 for FIG. 18 is made up of 42 inch diameter panels 13 and 19 and other panels not shown together with reducer panels 41, 43, 49, 51, 53, 59 and others not shown to reduce the diameter from 42 to 36 to 30 inches. The use of half-height panels is illustrated in the 30 inch diameter belt including panels 179 and 173 and other panels not shown. The belt including panels 61, 63 and 69 reduces the diameter from 30 inches to 26 inches above which is a cylindrical belt of 26 inch diameter including panels 223 and 229 and another panel. The form structure 418 is topped by the previously described reducer of 26 and 20 inches diameter including panels 91, 99 and two other panels.

The process of installing the liner using the apparatus illustrated in FIG. 18 would in general be the same as that previously described for FIG. 17 and previous figures.

Figure 19:
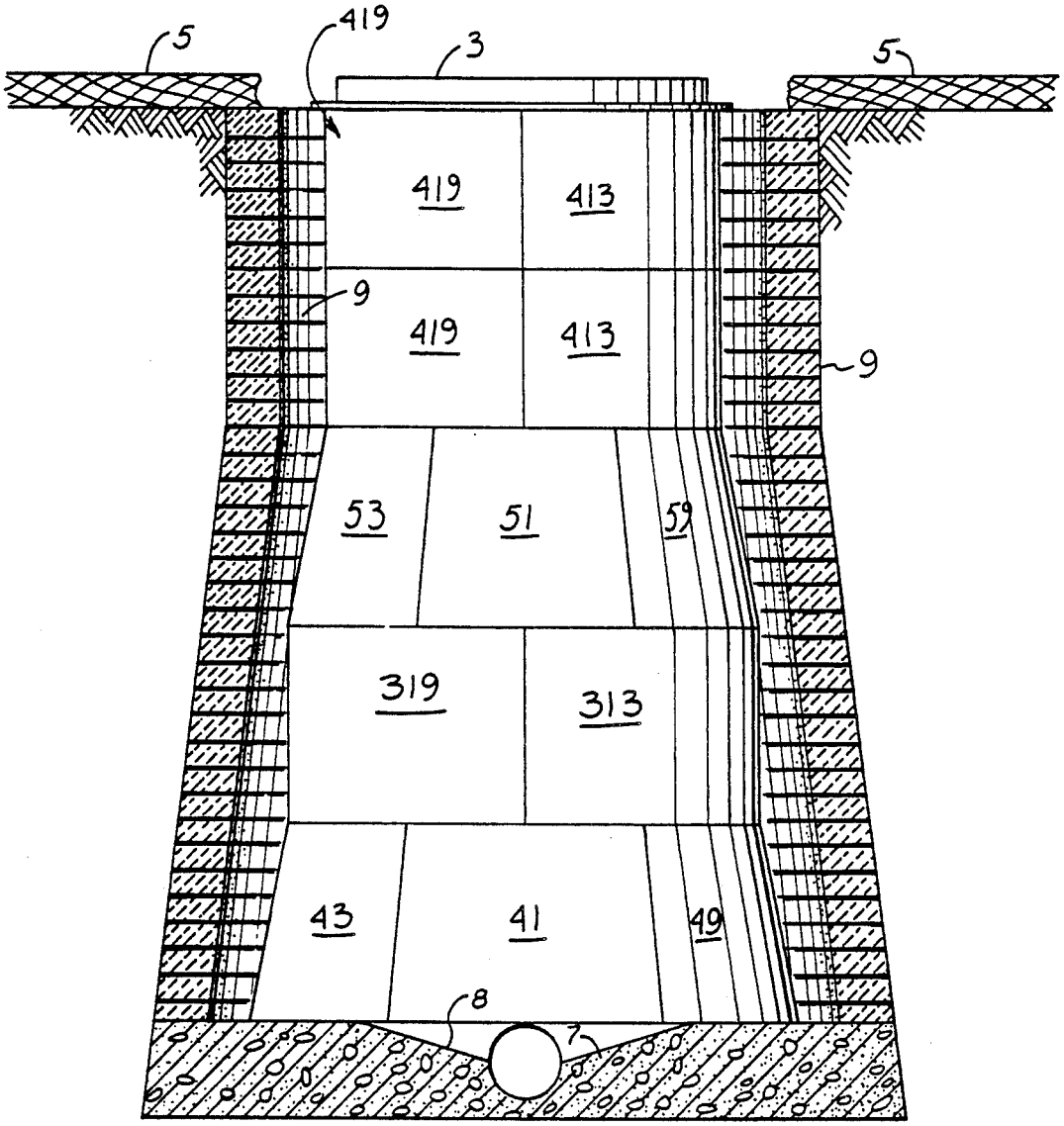
FIG. 19 is a side elevational view of a form structure for a manhole configuration with an untapered top portion and having a manhole cover ring embedded in the liner.

FIG. 19 shows a form structure 419 set up to permit a manhole liner to be poured flush with the street and the top of a manhole cover rim 3. The form structure 419 of FIG. 19 includes a reducer of 42 and 36 inch diameters including panels 41, 43, 49 and others not shown; a filler panel group including panels 313 and 319 together with other panels not shown, and a reducer of 36 and 30 inches diameter including panels 51, 53, 59 and other panels not shown.

The top portion of the form structure 419 is formed of 30 inch diameter cylindrical panels 413, 419 and others not shown which are selected to be of appropriate size to be covered by the manhole cover ring 3 so that the cover ring 3 will be embedded in the concrete at the top of the liner which is finished off flush with the pavement 5. Except for this last step of embedding the cover ring 3 in the concrete at the top of the liner, the process for forming the liner in the situation illustrated in FIG. 19 will be as previously described.

From the foregoing description, illustration and explanations it will be understood that apparatus and methods for forming liners to renew failing manhole wall structures or the like are provided by the present invention which restore the manholes to full effectiveness to prevent influx of ground water or rainwater in a deteriorating sewer system. With the apparatus and methods of the present invention this may be accomplished much more rapidly and at far less expense than would be involved in replacing, rebuilding, or repairing the existing manhole structures.

While numerous modifications and variations of the invention have been shown, described, or suggested above it will be apparent to those skilled in the art that other variations and modifications may be made within the scope of the invention and accordingly the scope of the invention is not to be considered limited to those embodiments shown or suggested, but is rather to be determined by reference to the appended claims.

TABLE I

| Regular Sizes | | | |
|---|---|---|---|
| Large D | Small D | Height | PCS/BELT |
| Common Reducers: | | | |
| 48 | 42 | 15 | 6 |
| 42 | 36 | 15 | 6 |
| 36 | 30 | 15 | 6 |
| 30 | 26 | 15 | 6 |
| 26 | 20 | 25 | 4 |
| Eccentric Reducers: | | | |
| 48 | 42 | 15 | 6 |
| 42 | 36 | 15 | 6 |
| 36 | 26 | 20 | 6 |
| Diam. | Heights | | PCS/BELT |
| Fillers: | | | |
| 48 | 15,8 | | 4 |
| 42 | 15,8 | | 4 |
| 36 | 15,8 | | 4 |
| 30 | 12,6 | | 4 |
| 26 | 12,6 | | 3 |
| Wedge Fillers: | | | |
| 42 | 0–2,0–4,0–8,0–15 | | 4(or 3 in 2" HT) |
| 36 | 0–2,0–4,0–8 | | 4(or 3 in 2" HT) |
| 30 | 0–2,0–4,0–8 | | 4(or 3 in 2" HT) |
| Super Sizes | | | |
| Large D | Small D | Height | PCS/BELT |
| Common Reducers: | | | |
| 60 | 54 | 30 | 10 |
| 54 | 48 | 30 | 10 |
| Diam. | Heights | | PCS/BELT |
| Fillers: | | | |
| 60 | 30,15,8 | | 10 |

TABLE I-continued

| | | |
|---|---|---|
| 54 | 30,15,8 | 10 |

I claim:

1. A method for casting a lining wall within an existing manhole having existing arcuate manhole sidewalls, a manhole floor, and a manhole top rim, and a horizontal top wall surrounding said top rim, said method comprising:

assembling a plurality of arcuate panels and arcuate key panels into a stack of a plurality of rings, commencing with a bottom ring adjacent said floor of said manhole and progressing upwardly with each successive ring being registered with and stacked above the preceding rings so as to combine to form a continuous smooth curved outer surface spaced radially inwardly from said arcuate manhole sidewalls to create an annular space therebetween, each of said rings having an upper edge and a lower edge, and said slack of rings including a top ring, said top ring being spaced below said horizontal top wall of said manhole;

each of said arcuate panels having opposite side flanges and opposite upper and lower flanges;

each of said arcuate key panels having a pair of opposite side flanges and a pair of middle flanges positioned between said opposite side flanges of said key panel, said opposite side flanges of each of said key panels each extending in first and second planes which are approximately parallel to one another, said pair of middle flanges being secured to one another and being detachable from one another to separate said one key panel into two separate panel parts, said pair of middle flanges extending in parallel third and fourth planes which are oblique with respect to said first and second planes in which said side flanges of each of said key panels lie;

said assembling of each of said rings being accomplished within said manhole by joining said side flanges of a plurality of said arcuate panels together so that said joined arcuate panels form a partial ring with two of said arcuate panels being first and second end panels, one of said side flanges of said first end panel being spaced from one of said side flanges of said second end panel to form a gap therebetween;

said assembling of each of said rings being further accomplished by inserting one of said key panels into said gaps and joining said side flanges of said key panel to said spaced apart side flanges of said first and second end panels so as to close said partial ring into a continuous enclosed ring;

filling said annular space between said stack of rings and said sidewalls of said manhole with concrete by filling a bottom portion of said annular space with said concrete to form a base wall having an upper base wall edge, permitting said concrete to set up, jacking said stack of rings upwardly until said upper edge of said top ring engages said horizontal top wall of said manhole and said lower edge of said bottom ring is below said upper base wall edge, and filling the remainder of said annular space with concrete up to and flush against said top wall of said manhole;

permitting said concrete to cure and harden;

removing said key panels from said rings after setting up of said concrete by detaching said oblique middle flanges of said key panels from one another and separating said key panels into said two separate panel parts for removal from said rings;

removing said remaining arcuate panels from said rings after said key panels have been separated and removed.

2. A method for casting a lining wall within an existing manhole having existing arcuate manhole sidewalls, a manhole floor, a manhole top rim, and a drop pipe inlet providing communication into said manhole at a point spaced above said floor, said method comprising:

assembling a plurality of arcuate panels and arcuate key panels into a slack of a plurality of rings, commencing with a bottom ring adjacent said floor of said manhole and progressing upwardly with each successive ring being registered with and stacked above the preceding rings so as to combine to form a continuous smooth curved outer surface spaced radially inwardly from said arcuate manhole sidewalls to create an annular space therebetween, each of said rings having an upper edge and a lower edge, and at least one of said panels in one of said rings having a drop pipe hole provided therein, said assembling further including positioning said drop pipe hole in vertical alignment below said drop pipe inlet;

each of said arcuate panels having opposite side flanges and opposite upper and lower flanges;

each of said arcuate key panels having a pair of opposite side flanges and a pair of middle flanges positioned between said opposite side flanges of said key panel, said opposite side flanges of each of said key panels each extending in first and second planes which are approximately parallel to one another, said pair of middle flanges being secured to one another and being detachable from one another to separate said one key panel into two separate panel parts, said pair of middle flanges extending in parallel third and fourth planes which are oblique with respect to said first and second planes in which said side flanges of each of said key panels lie;

said assembling of each of said rings being accomplished within said manhole by joining said side flanges of a plurality of said arcuate panels together so that said joined arcuate panels form a partial ring with two of said arcuate panels being first and second end panels, one of said side flanges of said first end panel being spaced from one of said side flanges of said second end panel to form a gap therebetween;

said assembling of each of said rings being further accomplished by inserting one of said key panels into said gaps and joining said side flanges of said key panel to said spaced apart side flanges of said first and second end panels so as to close said partial ring into a continuous enclosed ring;

filling said annular space between said stack of rings and said sidewalls of said manhole with concrete by filling a bottom portion of said annular space with said concrete to form a base wall having an upper base wall edge; permitting said concrete of said base wall to set up, jacking said stack of rings upwardly until said drop pipe hole is in registered vertical alignment with said drop pipe inlet; placing one end of a cylindrical drop pipe insert into said drop pipe inlet and the other end of said drop pipe insert through said drop pipe hole, and filling the remainder of said annular space with concrete up to said top rim thereof;

permitting said concrete to cure and harden;

removing said key panels from said rings after hardening of said concrete by detaching said oblique middle flanges of said key panels from one another and separating said key panels into said two separate panel parts for removal from said rings;

removing said remaining arcuate panels from said rings after said key panels have been separated and removed.

3. A method for casting a lining wall within an existing manhole while allowing fluid from connecting sewer pipes to flow through said manhole, said manhole having existing arcuate manhole sidewalls, a manhole floor, and a manhole top rim, at least one sewer inlet pipe having an inlet opening adjacent said floor of said manhole and at least one sewer outlet pipe having an outlet opening adjacent said floor whereby said fluid flows from said inlet opening across said manhole floor and into said outlet opening during casting of said lining wall; said method comprising:

assembling a plurality of arcuate panels and arcuate key panels into a plurality of rings, commencing with a bottom ring adjacent said floor of said manhole and progressing upwardly with each successive ring being registered with and stacked above the preceding rings so as to combine to form a continuous smooth curved outer surface spaced radially inwardly from said arcuate manhole sidewalls to create an annular space therebetween, each of said rings having an upper edge and a lower edge;

each of said arcuate panels having opposite side flanges and opposite upper and lower flanges;

each of said arcuate key panels having a pair of opposite side flanges and a pair of middle flanges positioned between said opposite side flanges of said key panel, said pair of middle flanges being secured to one another and being detachable from one another to separate said one key panel into two separate panel parts;

said assembling of each of said rings being accomplished within said manhole by joining said side flanges of a plurality of said arcuate panels together so that said joined arcuate panels form a partial ring with two of said arcuate panels being first and second end panels, one of said side flanges of said first end panel being spaced from one of said side flanges of said second end panel to form a gap therebetween;

said assembling of each of said rings being further accomplished by inserting one of said key panels into said gap and joining said side flanges of said key panel to said side flanges of said first and second end panels so as to enclose said partial ring into a continuous enclosed ring;

detachably joining a plurality of arcuate partial cylindrical segments together to form first and second multiple segment inserts which are cylindrical in shape, which have first ends sized to fit within said inlet and outlet openings of said sewer pipes respectively, which have second ends shaped to conform to the outer surface of said bottom ring, and which form a conduit extending therethrough;

placing said first ends of said first and second inserts within said inlet and outlet openings of said sewer pipes respectively;

placing said second ends of said first and second inserts into abutting mating relationship with said outer surface of said bottom ring whereby said first and second inserts span said annular space between said bottom ring and said sewer inlet and outlet openings respectively;

positioning at least a portion of said second ends of said first and second inserts below said lower edge of said bottom ring whereby said fluid flows from said first insert below said lower edge of said bottom ring onto said manhole floor and then below said lower edge of said bottom ring into said conduit of said second insert;

filling said annular space between said rings and said existing manhole sidewalls with concrete while said fluid flows through said existing manhole whereby said inserts shield said conduits and prevent said concrete from blocking or impeding said fluid flow through said conduits and across said manhole floor;

permitting said concrete to cure and harden;

removing said key panels from said rings after hardening of said concrete by detaching said oblique middle flanges of said key panels from one another and separating said key panels into said two separate panel parts for removal from said rings;

removing said remaining arcuate panels from said rings after said key panels have been separated and removed;

detaching and disassembling said partial cylindrical insert segments of said first and second inserts from one another after said curing of said concrete and removing said insert segments from said manhole after said disassembly.

4. A method according to claim 3 comprising forming a first group of said rings into substantially cylindrical rings with said upper and lower edges of said rings being approximately parallel to one another and forming at least one of said rings into a wedge shape with said upper edge and said lower edge of said wedge-shaped ring being inclined at an angle with respect to one another, said wedge-shaped ring combining with the others of said rings to create a crooked longitudinal axis for said continuous smooth curved surface formed by said rings.

5. A method according to claim 3 comprising securing said second ends of said first and second inserts to said outer arcuate surface of said bottom ring by bolt means extending through bracket means on each of said second ends of said first and second inserts, said bolt means also extending through said bottom ring, said securing being done so as to position a portion of each of said conduits above said lower edge of said bottom ring whereby fluid flows from said conduits below said lower edge of said bottom ring.

6. A method according to claim 3 wherein said manhole has an eccentric cone portion which is in the shape of a cone having a longitudinal cone axis at an inclined angle with respect to the longitudinal axis of the remainder of said manhole, said method comprising forming one or more of said rings into an eccentric cone section which has an arcuate outer surface conforming substantially to and spaced radially inwardly from said eccentric cone portion of said manhole.

* * * * *